US005922084A

United States Patent [19]

Fuchs et al.

[11] Patent Number: 5,922,084

[45] Date of Patent: Jul. 13, 1999

[54] PROCESS AND APPARATUS FOR APPLYING INDIGO DYESTUFF

[75] Inventors: Ralf Fuchs, Stolberg; Gerhard Voswinckel, Aachen; Hans Gerhard Wroblowski, Wuppertal, all of Germany

[73] Assignee: Sucker-Muller-Hacoba GmbH & Co., Monchengladbach, Germany

[21] Appl. No.: 09/027,415

[22] Filed: Feb. 20, 1998

[30] Foreign Application Priority Data

Feb. 22, 1997 [DE] Germany ..... 197 07 147

[51] Int. Cl.[6] ..... D06B 21/00

[52] U.S. Cl. ..... 8/149.1; 68/5 E; 68/9; 68/19.1

[58] Field of Search ..... 8/149.1; 68/5 D, 68/5 E, 9, 19.1, 20, 22 R

[56] References Cited

U.S. PATENT DOCUMENTS

| | | | |
|---|---|---|---|
| 2,415,379 | 2/1947 | Vieira | 68/5 E X |
| 3,546,901 | 12/1970 | Fleissner | 68/5 E |
| 3,608,109 | 9/1971 | Fleissner et al. | 8/149.1 |
| 5,337,586 | 8/1994 | Rinchi | 68/5 D |
| 5,378,246 | 1/1995 | Gurley | 8/625 |
| 5,403,362 | 4/1995 | Gurley | 8/625 X |

FOREIGN PATENT DOCUMENTS

| | | |
|---|---|---|
| 43 42 313 A 1 | 6/1995 | Germany . |
| 44 37 704 A 1 | 5/1996 | Germany . |

*Primary Examiner*—Philip R. Coe
*Attorney, Agent, or Firm*—Kennedy Covington Lobdell & Hickman LLP

[57] ABSTRACT

A process for applying indigo dyestuff on a textile substrate is described, wherein the substrate is saturated with liquid steeping liquor containing indigo dyestuff and the saturated substrate is directly passed through a first low-oxygen wet dwelling section and only thereafter is dewatered. To maximize the dyestuff yield or diffusion into the individual fibers of the substrate, a second enclosed low-oxygen wet dwelling section is defined by an essentially sealed housing which is connected to the first wet dwelling section. The substrate is initially heated in the second wet dwelling section and the substrate travels through the remainder of the second wet dwelling section for a sufficient time to permit diffusion of the dyestuff into the fibers of the still moist substrate.

6 Claims, 1 Drawing Sheet

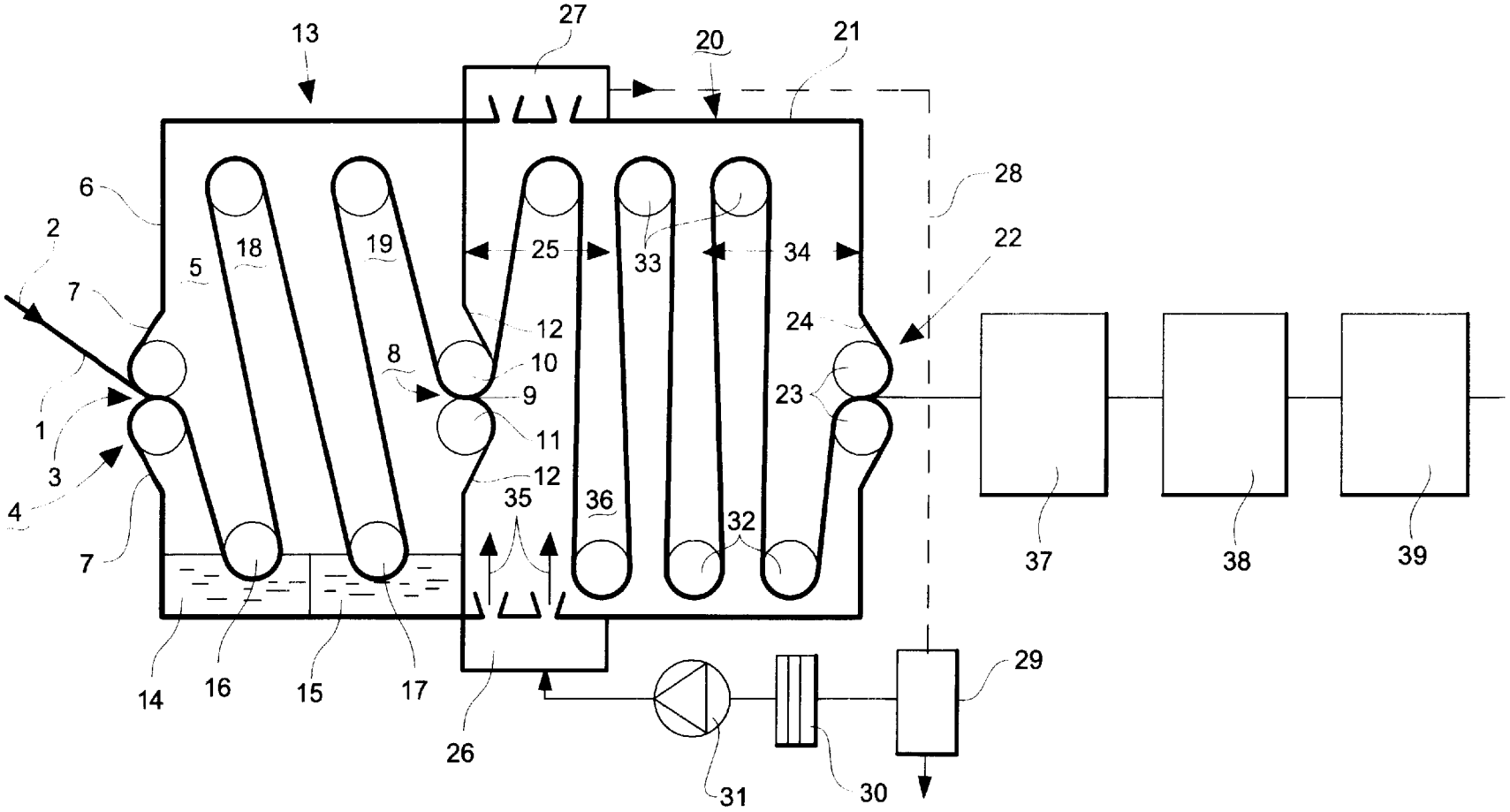
39
38
37
28
22
29
21
24
23
34
30
20
32
31
33
36
27
25
12
10
9
11
12
35
26
8
17
19
13
15
18
16
5
14
6
7
7
2
1
3
4

PROCESS AND APPARATUS FOR APPLYING INDIGO DYESTUFF

FIELD OF THE INVENTION

The present invention relates to a process of applying indigo dyestuff to a substrate embodied as a warp yam sheet, piece goods or fabric web, and more particularly to such a process wherein the substrate is conducted through a steeping bath containing a steeping liquor, the substrate is squeezed out before the steeping bath, and after the steeping bath the substrate saturated with the steeping liquor is conducted, as dripping wet as it leaves the steeping bath, through a first dynamic wet dwelling section, which is essentially maintained in a low-oxygen condition, and then the substrate is squeezed out. The invention further relates to an apparatus for executing the process, wherein a yarn-sheet or web-like substrate can be pulled or respectively conducted in the longitudinal direction through the apparatus, and piece goods can be transported through the apparatus on a carrier.

BACKGROUND OF THE INVENTION

Indigo dyestuff is a member of the group of the vat dyes; it is insoluble in water and for the purpose of dyeing it must be brought into a fiber-reactive, water-soluble form with the aid of alkali and reduction agents which, when oxidized by means of atmospheric oxygen, provides indigo blue. Other vat dyes, for example indanthrene and sulfur dyestuffs, are also understood by the term "indigo dyestuffs".

A method as mentioned above is described in German Patent Publication DE 43 42 313 A1 for use with warp yam sheets. A relatively small vat is provided with this known method for applying the dyestuffs, a first wet dwelling section being connected downstream of the vat prior to squeezing, i.e. mechanical dewatering, with a low-oxygen atmosphere therefore to effectively function in relation to the diffusion of the dyestuff into the interior of the individual fibers as an extension of the vat. The substrate is moved at full conveying speed in the wet-dwelling section, which is therefore called a dynamic dwelling section.

It is possible to use installations in connection with indigo dyeing, in particular when dyeing warp yarn sheets, which in their basic structure are similar to sizing machines. A sizing machine with an extremely short steeping bath is described in German Patent Publication DE 44 37 704 A1. In this known machine, the lower half of the circumference of one squeezing roller of a squeezing unit serves as a sizing contact section. A steeping vat is not required with this known machine.

A problem when dyeing with indigo is in that the colorations obtained often have insufficient crock fastness, or require extensive rinsing sections, because of the basically low bath and liquor exhaustion. The (reduced) dye remnant which has remained in the liquor can begin to oxidize there already. In the course of the operation, this oxidized dyestuff is also deposited on the textile substrate. However, the previously oxidized dyestuff can no longer assist with real dyeing, since it can no longer be fixed on the fibers.

In order to overcome this problem, it is proposed in the unpublished German Patent document DE 196 28 806 A1, to perform dyeing, or respectively the absorption of the reduced indigo dyestuff by the fiber, in the presence of high electrolyte concentrations, and to maintain the high electrolyte concentration up to the reoxidation of the reduced dyestuff (for forming the-dye pigment). This can be achieved in that the substrate soaked with the steeping liquor is brought to the oxidation process without prior rinsing, since the substrate received after squeezing the liquor out still contains sufficient amounts of electrolyte. The known method makes possible the continuous dyeing of cellulose-containing textiles with indigo in a single operation, in that the reduced indigo is absorbed by the textile material in the presence of an aqueous liquor as the electrolyte, containing reduction agents, alkali, and in addition a further dissolved alkali metal salt at a concentration between 200 and 350 grams per liter (g/l), whose pH value has been set between 10.2 and 11.3, then the reduced indigo absorbed by the fibers is again oxidized into a pigment while maintaining the high electrolyte concentration, and dyeing is finished in a customary manner.

If the method in accordance with German Patent Document DE 196 28 806 A1 were combined with the method in accordance with German Patent Publication DE 43 42 313 A1—possibly while employing the principles of German Patent Document DE 44 37 704 A1—good dyestuff yields would result, but a considerable portion of the dyestuff used would continue to reach the rinsing bath downstream of the oxidation process.

SUMMARY OF THE INVENTION

It is accordingly an object of the present invention to further improve the application of indigo dyestuff and, particularly the dyestuff increase, which is delayed because of the addition of electrolyte, with the aim of diffusing, if possible, the entire amount of dyestuff taken along by a substrate into its individual fibers prior to oxidation.

To attain this object, it could be attempted to increase the wet dwelling section described in German Patent Document DE 43 42 313 A1. However, in relation to the outlay, tests have only shown relatively unconvincing results. It could also be attempted to heat the interior of the chamber containing the known wet dwelling section above the vat in order to increase the diffusion speed of the dyestuff. However, in the process the liquor contained in the vat would be heated in an inadmissible manner. The present invention offers a solution to these problems in accordance with the above mentioned object.

The object in accordance with the present invention in connection with the basic process described above is attained in that the substrate, containing an initial amount of moisture defined by the squeezing process is first heated in an entry area, i.e. a first zone, of a second wet dwelling section, which is kept low in oxygen, for example by blowing a heated gas on the substrate, and that thereafter the dyestuff is given time, prior to oxidation, for the further diffusion into the fibers of the still moist substrate during the stay in a second zone of the second wet dwelling section up to its outlet area.

An essential characteristic of the invention resides in that the substrate, which is already impregnated (without oxidation) in a wet dwelling section in accordance with German Patent Document DE 43 42 313 A1, is initially heated in a second, downstream low-oxygen wet dwelling section and then, at an increased temperature, time is given to the dyestuff for further diffusion into the interior of the still moist (but heated) substrate. In this connection it is preferred to perform heating only in the entry area of the second wet dwelling section, i.e. in a first zone, for example in the first third, of the second wet dwelling section, because otherwise the result would be premature drying, which would make further dyestuff diffusion impossible. Thus, a two-stage process is created by means of the invention: a first step wherein the liquid steeping liquor is applied in any appropriate manner to the substrate, for example in a vat, and thereafter the dyestuff is given time to be absorbed by the fibers in a low oxygen (or an essentially oxygen-free) atmosphere, and a second step wherein the dyestuff and the substrate are initially heated, also in a low-oxygen atmosphere, and the dyestuff is again given time while in the low-oxygen atmosphere to diffuse into the fibers of the still moist substrate.

In accordance with a further aspect of the invention, an apparatus for executing the claimed process basically comprises a first dwelling chamber containing the first wet dwelling section and, downstream thereof, a second dwelling chamber, also maintained low in oxygen, which has an entry area (first zone) comprising a third of the substrate conveyance path, the second dwelling chamber having means for blowing on the substrate a heated, low-oxygen, or oxygen-free gas, in particular an inert gas or water vapor.

Because the invention provides downstream of a first (dynamic) dwelling chamber (as described in German Patent Document DE 43 42 313 A1) a second low-oxygen or oxygen-free (dynamic) wet dwelling section, in which an interfering oxidation of the dyestuff therefore cannot yet start, but wherein the dyestuff diffusion is accelerated by initial heating without drying, an almost 100% dye extraction can be achieved in actual use if an electrolyte, for example salt in accordance with German Patent Document DE 196 28 806 A1, is added to the steeping bath, or alternatively an electrolysis bath is placed upstream of the steeping bath. The salt concentration in the pre-bath or the steeping bath may be more than 150 grams per liter (g/l).

The second wet dwelling section in accordance with the invention should be charged with a heated, low-oxygen, or oxygen-free gas in its entry area, i.e. approximately in the first third of the substrate conveying length. It is possible to use a heated gas, such as an inert gas or water vapor, adapted to the process for this purpose. The temperature of the substrate can slowly fall in the course of the remainder of the conveying length of the second wet dwelling section.

In an exemplary embodiment, it is sufficient for a dynamic dwelling section (a diffusion zone or second zone) following the heating zone of the second wet dwelling section to be of a length in the conveying direction which will achieve a diffusion time of an order of magnitude of one-half to one minute, depending on the pairing of the materials (substrate/type color). With a conveying speed of 100 meters per minute (m/min) this corresponds to a conveying length of approximately 50 to 100 meters inside the chamber of the second wet dwelling section. The length of the diffusion zone (second zone), following the heating zone (first zone), within the second wet dwelling section can also be used for the control of the shade to be achieved.

The substrate should leave the second wet dwelling section through a slit which is sealed as tightly as possible against the entry of ambient air, and should pass through an oxidation stage of the conventional type, possibly with the interposition of a dryer, for example an infrared dryer. Following the oxidation section, the substrate should be passed through a rinsing installation, in which the substrate is rinsed of any remaining unfixed dye and especially the electrolyte applied at the start of the described dyeing process, in particular at the entry to the second dwelling stage.

Further details of the invention will be explained hereinafter with reference to a schematic representation of an exemplary embodiment as shown in the accompanying drawing.

BRIEF DESCRIPTION OF THE DRAWINGS

The drawing is a schematic diagram of an apparatus for applying indigo dyestuff according to one preferred embodiment of the invention.

DETAILED DESCRIPTION OF THE PREFERRED EMBODIMENT

In accordance with the attached drawing, a substrate 1, in particular a warp yarn sheet or a textile material web, passes through a squeeze gap 3 of an inlet squeeze unit 4 into the interior of an enclosed housing 6. At the substrate inlet side, the housing 6 is sealed by the inlet squeeze unit 4, preferably in the form of a pair of abutting pinch or nip rollers, to opposite sides of which squeegee seals 7 are contacted in a manner customary in the technology. At the side where the substrate 1 exits the housing 6, the housing 6 is similarly sealed by an outlet squeeze unit 8 also comprised of two rollers 10, 11. In the process, the substrate 1 passes between the roller gap 9 of the two rollers 10 and 11, which are pressed against each other on opposite sides. Squeegee seals 12 are also contacted with the rollers 10, 11 at opposite sides of the roller gap 9. The two squeezing units 4 and 8 form the lock-like, sealed inlets and outlets of a first wet dwelling section 13. In the exemplary embodiment, the substrate 1 is conveyed within the housing 6 of the first wet dwelling section 13 through two vats 14 and 15, each with a respective steeping roller 16 and 17, submerged partially in an electrolyte, in particular a sodium chloride solution, in the case of the roller 16 in the vat 14, and in a steeping dye liquor, in the case of the roller 17 in the vat 15. It is alternatively possible to provide only one vat containing the electrolyte and the dyestuff. In still another alternative, the electrolyte can already have been applied to the substrate 1 ahead of the inlet roller squeeze unit 4.

In the exemplary embodiment represented in the drawings, a dwelling section follows both the submergence or steeping in the electrolyte of vat 14 and the submergence or steeping in the steeping liquor vat 15 by causing the substrate to travel upwardly in loops 18, 19. This division of the first wet dwelling section 13 can be advantageous, because the substrate 1 reaches the steeping trough 15 with electrolyte already diffused in the substrate. It is important that the atmosphere within the first wet dwelling section 13 is maintained oxygen-free or at least low in oxygen in the space above the vat 14, and the vat 15, i.e. in the interior 5 of the housing 6. The two squeezing units 4 and 8, and in particular the inlet squeezing unit 4, therefore should be airtight to a large extent. The length of the wet dwelling section (i.e. the conveying length of substrate travel in the conveying direction 2) should be sufficiently long so that, under the given circumstances, an optimal dyestuff diffusion into the individual fibers is achieved in the first wet dwelling section 13. In place of the loops 18 and 19, which are understood to be symbolic, it is therefore possible to provide considerably more dwelling loops.

The dyestuff diffusion, which in the first wet dwelling section 13 takes place essentially without oxidation, is perfected in a second, low-oxygen or oxygen-free wet dwelling section 20. The second wet dwelling section 20 is located in a housing 21, whose inlet is formed by the outlet squeeze unit 8 of the first wet dwelling section 13. With approximately the same pressure conditions in the wet dwelling sections 13 and 20, a separate seal or air lock between the sections 13, 20 can be omitted, so that the outlet squeezing unit 8 essentially only has the function of mechanically dewatering the substrate 1. However, the housing 21 of the second wet dwelling section 20 does have an outlet sealing unit 22 preferably embodied as a gap, for example between two opposed pinch rollers 23 pressed against each other with opposing squeegee seals 24, intended to seal the housing 21 against the penetration of ambient air.

Essentially two treatment zones are provided in the housing 21 of the second wet dwelling section 20. A first zone 25 comprises approximately one-third of the overall conveying length of travel by the substrate through the housing 21 and has a heated, low-oxygen or oxygen-free gas blown into the first zone 25, for example at the housing bottom, via a nozzle manifold 26. At the top or ceiling of the housing 21, the gas is exhausted by means of a collector 27 in order to be recycled to the nozzle manifold 26 via a line 28, a water separator 29, a heat exchanger 30 and a blower 31. By conveying the substrate 1 vertically in the second wet dwelling section 20 in loops between lower rollers 32 and upper rollers 33, it is possible, in spite of the lack of a wall inside the housing 21, to achieve a clearly different treatment effect on the substrate in the first zone 25 than in the second zone 34, which follows at the end of the second wet dwelling section 20. The gas flow 35 coming out of the nozzle manifold 26 is noticeably hindered by the loops 36 from flowing from the first zone 25 in the direction toward the second zone 34.

In the exemplary embodiment, a drying section 37, for example an infrared dryer or a cylinder dryer, follows the second wet dwelling section 20. Following drying, the substrate 1 passes through an oxidation section 38. If, for example, the substrate 1 is a warp yam sheet, it can be heated to approximately 120° C. in the dryer. The temperatures in the oxidation section 38 are approximately 50° C. A rinsing section 39 preferably follows the oxidation section 38, in which the electrolyte and possible remnants of non-fixed dyestuff are rinsed out.

By means of the described process, carried out by the described apparatus, it is possible to absorb the dyestuff almost completely in the fibers, often to more than 90%, in particular up to 95%, of the dyestuff employed, and to fix the absorbed dyestuff in the fibers. To this end, the invention provides a sufficient dwelling time not only in the first wet dwelling section 20, but after heating also in the second wet dwelling section 20, so that an intensive material exchange can be achieved in both sections. The directed blowing on the substrate in the inlet zone 25 of the second wet dwelling section 20 is particularly advantageous for such result.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A process of applying indigo dyestuff to a fibrous substrate, comprising the steps of conveying the substrate sequentially through a first squeezing location, a steeping bath containing a steeping liquor including an indigo dyestuff, a first wet-dwelling section having a low oxygen atmosphere wherein the substrate is essentially saturated with the steeping liquor, a second squeezing location, and then first and second zones of a second wet dwelling section, the first zone being heated and having a low oxygen atmosphere and the second zone being arranged to provide sufficient conveying time of the substrate therein for the dyestuff from the steeping liquor to diffuse into the fibers.

2. An apparatus for applying indigo dyestuff to a fibrous substrate, comprising a first substrate squeezing location, a steeping bath containing a steeping liquor including an indigo dyestuff, a first wet dwelling section having a low oxygen atmosphere, a second substrate squeezing location, a second wet dwelling section having a first zone which is heated and has a low oxygen atmosphere and a second zone for dyestuff diffusion into the substrate, and means for conveying the substrate sequentially through the first substrate squeezing location, the steeping bath, the first wet dwelling section, the second substrate squeezing location, the first zone of the second wet dwelling section and the second zone of the second wet dwelling section, the conveying means being arranged to provide sufficient conveying time of the substrate in the second zone for the dyestuff from the steeping liquor to diffuse into the fibers.

3. An apparatus in accordance with claim 2, and further comprising a first dwelling chamber for defining the first wet dwelling section and downstream thereof a second dwelling chamber for defining the second wet dwelling section, the first zone of the second dwelling section comprising about one-third of the length of substrate conveyance through the second dwelling chamber and the second dwelling chamber having means for blowing a heated, low-oxygen gas onto the substrate in the first zone.

4. An apparatus in accordance with claim 3, wherein the second dwelling chamber is arranged to maintain a conveyance time period of the substrate in the second zone on an order of magnitude of one-half to one minute for diffusion of the dyestuff into the fibers.

5. An apparatus in accordance with claim 2, wherein the second dwelling chamber has means for blowing into the first zone a heated gas selected from the group comprised of inert gases and water vapor.

6. An apparatus in accordance with claim 2, and further comprising a drying section following the second dwelling chamber, a dyestuff oxidation section following the drying section, and a substrate rinsing section following the oxidation section.

* * * * *